US005118083A

United States Patent [19]

Metzen

[11] Patent Number: 5,118,083

[45] Date of Patent: Jun. 2, 1992

[54] CAR JACK

[75] Inventor: Wolfgang Metzen, Kell, Fed. Rep. of Germany

[73] Assignee: August-Bilstein GmbH & Co. KG, Ennepetal, Fed. Rep. of Germany

[21] Appl. No.: 698,832

[22] Filed: May 10, 1991

[30] Foreign Application Priority Data

May 16, 1990 [DE] Fed. Rep. of Germany ... 9005575[U]

[51] Int. Cl.[5] ..... B66F 3/12

[52] U.S. Cl. ..... 254/126

[58] Field of Search ..... 254/122, 124, 126, DIG. 1

[56] References Cited

U.S. PATENT DOCUMENTS 4,015,825 4/1977 Graafsma et al. ..... 254/DIG. 1
4,093,182 6/1978 Rutenbeck ..... 254/126
4,765,595 8/1988 Alten ..... 254/122

FOREIGN PATENT DOCUMENTS 2134075 8/1984 United Kingdom ..... 254/126

*Primary Examiner*—Robert C. Watson
*Attorney, Agent, or Firm*—Max Fogiel

[57] ABSTRACT

A jack in which a base plate is pivotable on an upright to a bottom surface. A supporting arm is also pivotable on the upright, and is actuated for being pivoted. The base plate is held in a predetermined position by a spring which has two sections. A first section of the spring rests against the upright and the base plate, whereas the second section of the spring rests against the base plate and an end of the supporting arm when this arm is completely folded up against the upright. The second section of the spring, furthermore, generates a spring torque which is directed opposite to the spring torque that is generated by the first spring section. The spring torque of the second spring section, moreover, exceeds the spring torque of the first spring section.

7 Claims, 5 Drawing Sheets

CAR JACK

BACKGROUND OF THE INVENTION

A jack of this type with a base plate that is pivoted into the ready-to-use position in relation to an upright by a spring is disclosed in German 3 603 311 A1. One drawback to this jack is that the base plate is pivoted as far as possible along the upright when the jack is in the disengaged position. This extends the overall length of the jack when completely folded together and makes it difficult to stow in the luggage compartment of an automobile.

SUMMARY OF THE INVENTION

The object of the present invention in to improve a jack of the type described to the extent that it will be short enough when completely folded together to stow easily, whereas the base plate will be ready to use when applied to the vehicle and will lie as flat as possible against the ground.

The advantages obtainable with the invention consist in particular in that simple means are sufficient without additional components to make the jack short enough to stow easily in its completely folded state and to ensure that the base plate will be in the ready-to-use position when the jack is applied to the vehicle.

BRIEF DESCRIPTION OF THE DRAWINGS

One embodiment of the invention will now be specified with reference to the drawing, wherein.

DESCRIPTION OF THE PREFERRED EMBODIMENTS

Figure 1:
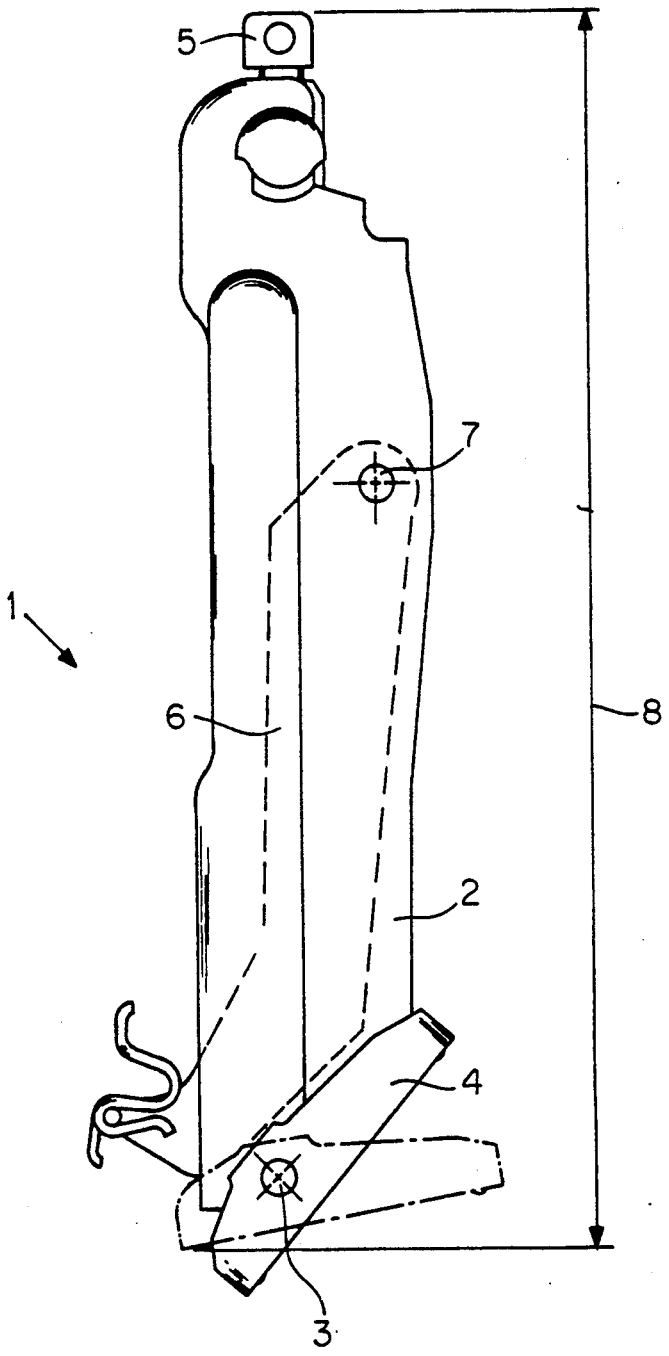
FIG. 1 is a view of a jack.

As will be evident from FIG. 1, a jack 1 consists of an upright 2 with a base plate 4 articulated to its bottom end at an articulation 3. An activating mechanism 5, a threaded spindle in the illustrated embodiment, pivots a supporting arm 6 around a pivot 7 on the upright. The continuous and dot-and-dash lines show base plate 4 in its two outermost positions. A single-component helical spring 9 has two free ends 10 and 11. One section 12 of the spring 9 extends between upright 2 and base plate 4 and comprises the shorter free end 10, the coils 13, and the first component of the longer free end 11 of spring 9. Another section 14 consists of the longer free end 11 and comprises an open loop 15 and a straight extension 16 that ends in a closed loop 17. The I articulation 3 between upright 2 and base plate 4 is a bolt that extends through them. The coils 13 of helical spring 9 extend around the bolt.

Figure 2:
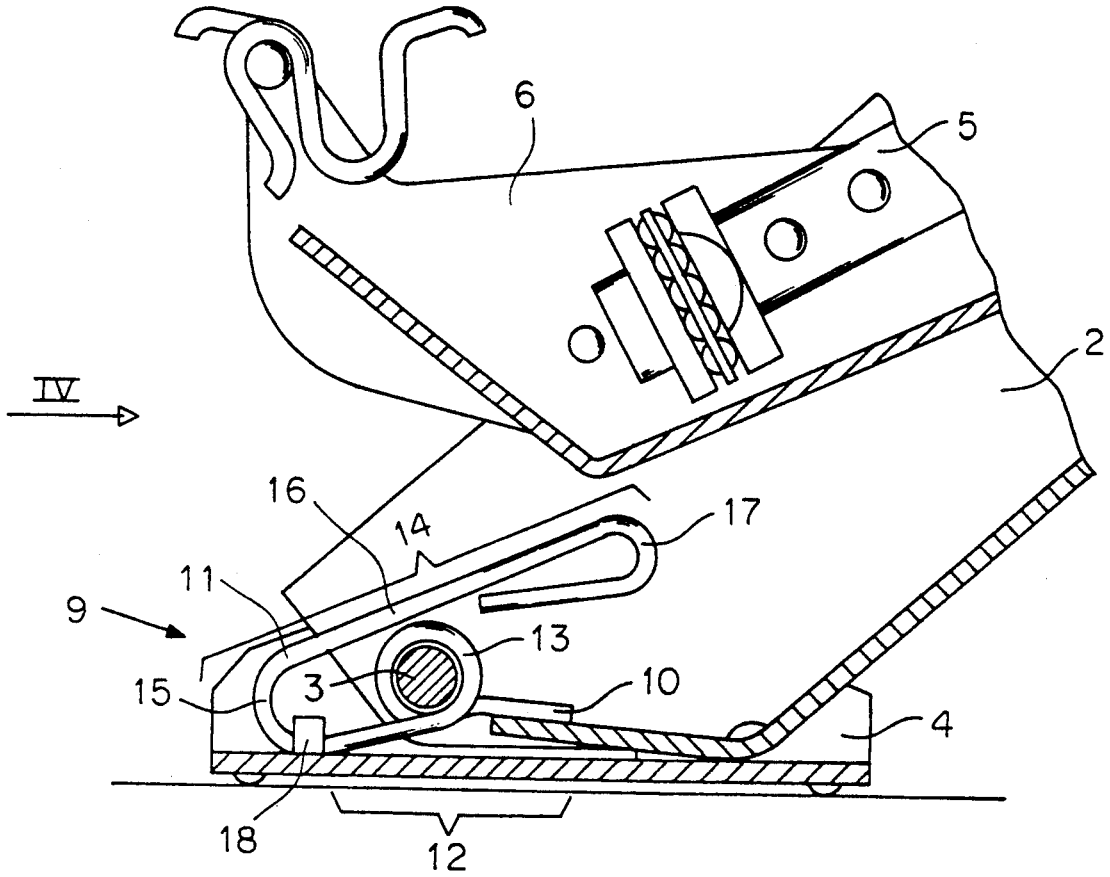
FIG. 2 is a section through the bottom of the jack in FIG. 1 in use.

When the jack is in the in-use position illustrated in FIG. 2, the shorter free end 10 and the longer free end 11 of spring 9 rest press against upright 2 and base plate 4. The base plate is accordingly pivoted into the ready-to-use position, resting against upright 21

Figure 3:
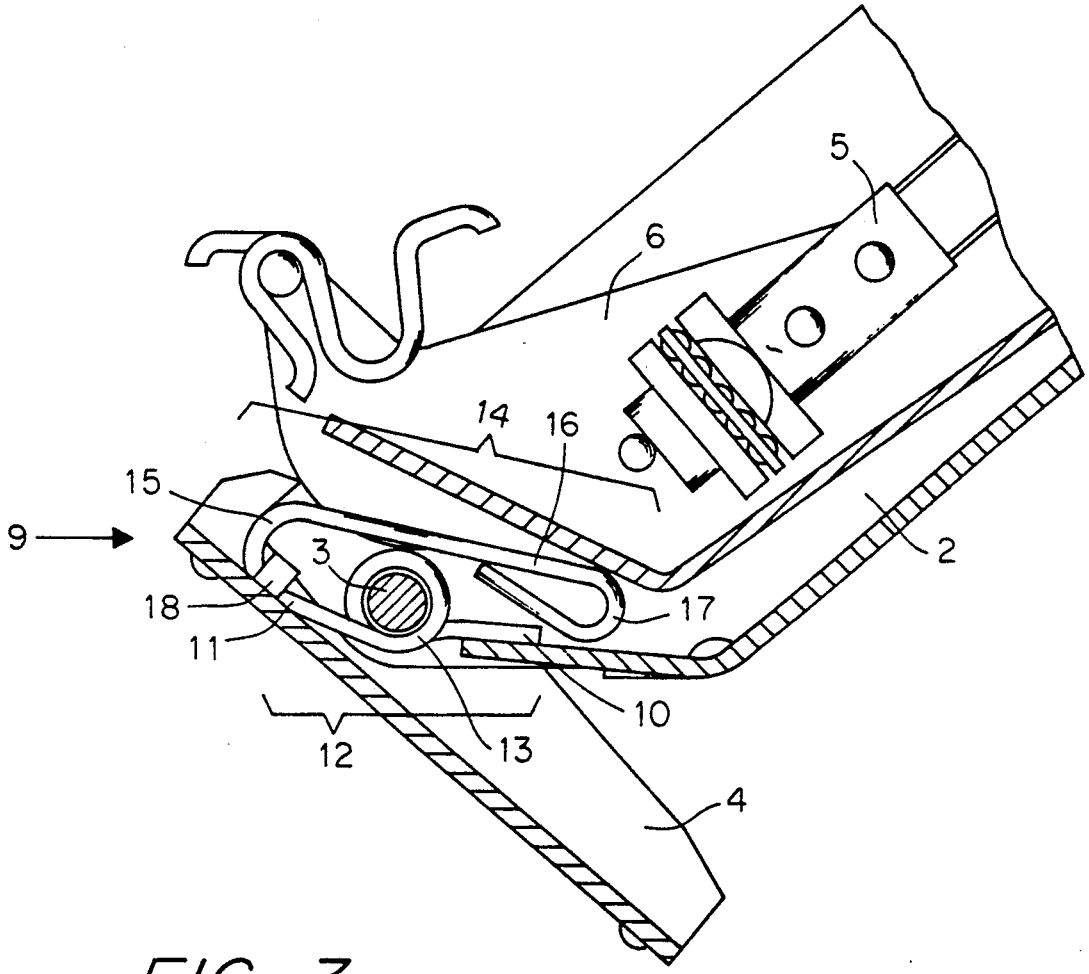
FIG. 3 is a section like that in FIG. 2 through a jack ready for stowing.
Figure 4:
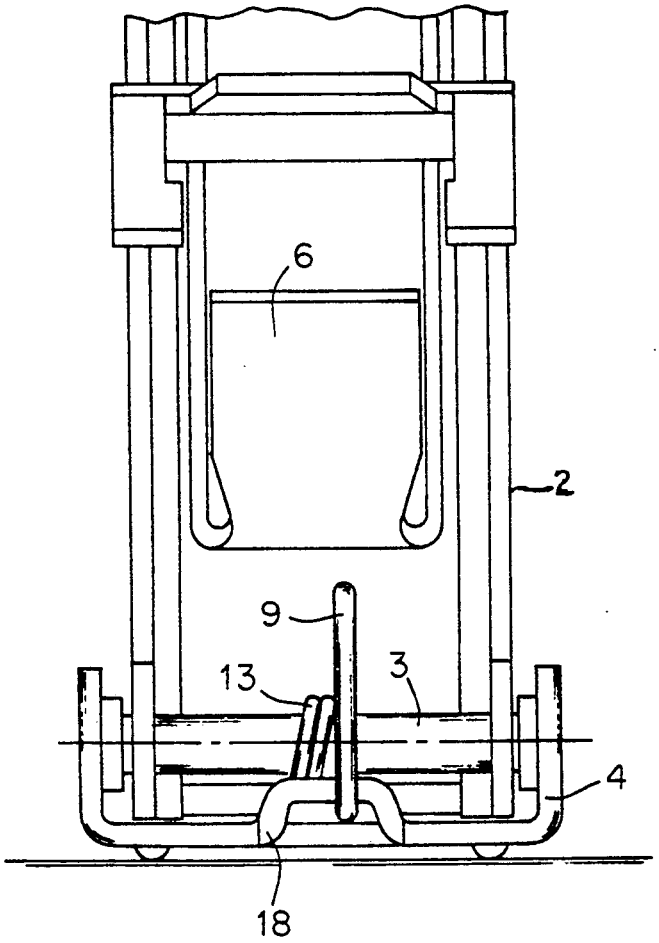
FIG. 4 is a view of FIG. 2 in direction IV.

When the jack is in the ready-to-stow position illustrated in FIG. 3, supporting arm 6 is as close to upright 2 as possible. The upright is accordingly forced against the straight extension 16 of the longer free end 11 of spring 9. The particular spring characteristic ensures that the force that pivots base plate 4 will be eliminated, and base plate 4 can pivot more or less perpendicular to upright 2. A carrier 18, which can be stamped out of upright 2, secures the first component of the longer free end 11 of spring 9 to base plate 4.

Figure 5:
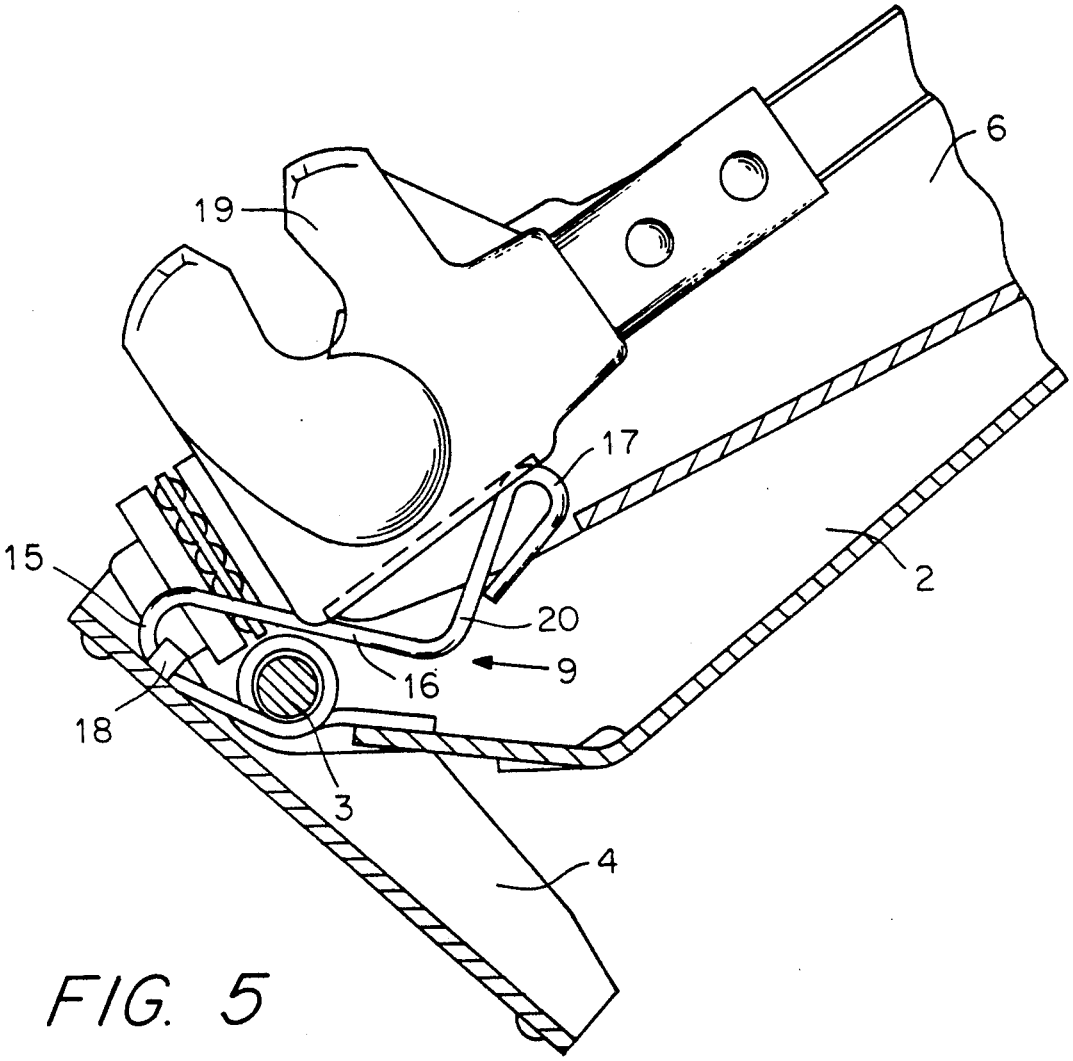
FIG. 5 is a section like that in FIG. 2 with a load-bearing head on the supporting arm.

The supporting arm 6 in the embodiment illustrated in FIG. 5 has a load-bearing head 19. A bent section 20 adjoins the straight extension 16 of the longer free end 11 of spring 9, and load-bearing head 19 rests against it when the jack is in the ready-to-stow position, pivoting base plate 4.

I claim:

1. A jack comprising: an upright; a base plate pivotable about a pivot on said upright to a bottom surface; a supporting arm pivotable on said upright; actuating means for actuating said supporting arm to pivot said supporting arm on said upright; spring means for holding said base plate in a predetermined position; said spring means having two sections, a first one of said two sections resting against said upright and said base plate, and a second one of said two sections resting against said base plate and an end of said supporting arm when said supporting arm is completely folded up against said upright, said second section of said spring means generating a spring torque directed opposite to a spring torque generated by said first section of said spring means, the spring torque of said second section exceeding the spring torque of said first section.

2. A jack as defined in claim 1, wherein said spring means comprises a single one-piece member.

3. A jack as defined in claim 1, wherein said spring means comprises a helical spring having free ends.

4. A jack as defined in claim 3, wherein a first one of said free ends of said helical spring rests against said upright, a second one of said free ends resting against said base plate and having an extended portion resting against said end of said supporting arm when completely folded up.

5. A jack as defined in claim 4, wherein said extended portion comprises an open loop section connected to a straight-extended section.

6. A jack as defined in claim 3, wherein said pivot has a pivoting axis, said helical spring having coils and an axis extending substantially in vicinity of said pivoting axis on said base plate.

7. A jack as defined in claim 6, wherein said pivot comprises a bolt member, said spring having coils surrounding said bolt member.

* * * * *